US005518380A

United States Patent [19]

Fujii et al.

[11] Patent Number: 5,518,380

[45] Date of Patent: May 21, 1996

[54] VARIABLE DISPLACEMENT PUMP HAVING A CHANGEOVER VALUE FOR A PRESSURE CHAMBER

[75] Inventors: Tadaaki Fujii; Hiroto Iwata; Yuuichi Kimura, all of Saitama, Japan

[73] Assignee: Jidosha Kiki Co., Ltd., Tokyo, Japan

[21] Appl. No.: 380,575

[22] Filed: Jan. 30, 1995

[30] Foreign Application Priority Data

Feb. 28, 1994 [JP] Japan ..... 6-052659

[51] Int. Cl.[6] ..... F04C 15/04

[52] U.S. Cl. ..... 418/26; 418/27; 418/30

[58] Field of Search ..... 418/24–27, 30; 417/220

[56] References Cited

U.S. PATENT DOCUMENTS

| | | | |
|---|---|---|---|
| 2,628,567 | 2/1953 | De Lancey et al. | 418/26 |
| 2,635,551 | 4/1953 | De Lancey | 417/220 |
| 2,811,926 | 11/1957 | Robinson, Jr. | 418/26 |
| 2,878,756 | 3/1959 | O'Connor et al. | 418/26 |
| 2,975,717 | 3/1961 | Rynders et al. | 418/26 |
| 3,272,139 | 9/1966 | Rosaen | 418/82 |
| 3,656,869 | 4/1972 | Leonard | 417/220 |
| 4,035,105 | 7/1977 | Dantlgraber | 418/26 |
| 4,342,545 | 8/1982 | Schuster | 418/30 |
| 4,431,389 | 2/1984 | Johnson | 418/268 |
| 4,496,288 | 1/1985 | Nakamura et al. | 418/30 |
| 4,632,638 | 12/1986 | Shibayama et al. | 417/220 |
| 4,678,412 | 7/1987 | Dantigraber | 417/220 |
| 4,681,517 | 7/1987 | Schulz et al. | 417/310 |
| 5,090,881 | 2/1992 | Suzuki et al. | 418/26 |
| 5,098,259 | 3/1992 | Ohtaki et al. | 417/310 |
| 5,226,802 | 7/1993 | Nakamura et al. | 417/310 |
| 5,266,018 | 11/1993 | Niemiec | 418/268 |
| 5,290,155 | 3/1994 | Snow et al. | 418/82 |

FOREIGN PATENT DOCUMENTS

| | | | |
|---|---|---|---|
| 3322549 | 3/1986 | Germany | 418/30 |
| 53-130505 | 11/1978 | Japan . | |
| 53-140605 | 12/1978 | Japan | 418/26 |
| 56-143383 | 11/1981 | Japan . | |
| 58-93978 | 6/1983 | Japan . | |
| 58-170870 | 10/1983 | Japan | 418/26 |
| 63-14078 | 4/1988 | Japan . | |
| 4-358801 | 12/1992 | Japan . | |
| 5223064 | 8/1993 | Japan | 418/30 |

*Primary Examiner*—John J. Vrablik

*Attorney, Agent, or Firm*—Sughrue, Mion, Zinn, Macpeak & Seas

[57] ABSTRACT

A cam ring for forming a pump chamber on the outer periphery of a rotor which is rotatable in a body is arranged movably, and is urged in a direction in which the volume of the pump chamber is made maximum. Sealing means are interposed in an annular gap space on the outer periphery of the cam ring between the cam ring and the body, thereby forming first and second fluid-pressure chambers for allowing the cam ring to undergo displacement by moving. A spool-type changeover valve is provided which is operated in accordance with the discharge flow rate of the pressure fluid from the pump chamber to control the fluid pressure supplied to the first and second fluid-pressure chambers. The fluid pressure on the downstream side of a metering orifice 29 provided in a pump discharge-side passage 28 is introduced into the second fluid-pressure chamber for imparting moving displacement in the direction in which the volume of the pump chamber is made maximum, through a passage 37 via a second valve chamber **32*b***. It is possible to control the swinging of the cam ring, and to prevent fluctuations in the flow rate and a decline in the flow rate on the discharge side of the pump.

9 Claims, 6 Drawing Sheets

VARIABLE DISPLACEMENT PUMP HAVING A CHANGEOVER VALUE FOR A PRESSURE CHAMBER

BACKGROUND OF THE INVENTION a) Field of the Invention

The present invention relates to a variable displacement pump for use in equipment using pressure fluid, such as a power steering apparatus for alleviating the force for operating the steering wheel of an automobile.

b) Discussion of Related Art

Conventionally, fixed displacement vane pumps which are rotatively driven directly by an automobile engine have generally been used as pumps for power steering apparatuses. With such fixed displacement pumps, however, since the discharge flow rate increases or decreases in correspondence with the revolution rate of the engine, i.e., a driving source, the fixed displacement pumps have characteristics which are mutually contradictory to those of the power steering apparatus that require a large steering-assisting force during a standstill or low-speed running and a small steering-assisting force during high-speed running.

Accordingly, as such a pump, one is used which is capable of securing a discharge flow rate that makes it possible to obtain a required steering-assisting force even during low-speed running when the number of revolutions per unit time is small. At the same time, a flow control valve is required for controlling the discharge flow rate to a fixed level or lower when the number of revolutions has become large. For this reason, with such a pump, the number of component parts used increases, the structure becomes complex, and the structures of passages are also complex, inevitably making the overall apparatus large in size and resulting in higher cost.

In addition, if the flow control valve is used, the discharge flow is recirculated to the tank side, so that there are also problems in that the required driving power becomes large, the energy loss is large, and the oil temperature rises.

To overcome the drawbacks of the fixed displacement pumps, various variable displacement pumps which are capable of reducing the discharge flow rate in a step-wise manner with an increase in the number of revolutions have been proposed, as disclosed in Japanese Patent Application Laid-Open Nos. 53-130505, 56-143383, and 58-93978, and Japanese Utility Model Application Publication No. 63-14078.

Such variable displacement pumps do not require the flow control valve used in the fixed displacement type, prevent a wasteful increase in driving power, and excel in the energy efficiency. Moreover, such variable displacement pumps are capable of reducing the rise in oil temperature since there is no return flow to the tank side, and are capable of preventing problems such as leakage in the pump interior and a decline in the volume efficiency.

The variable displacement pumps disclosed in Japanese Patent Application Laid-Open No. 56-143383 and the like are arranged as follows: A cam ring is arranged movably in a pump casing, a pair of fluid chambers serving as control chambers are formed in a gap formed between the cam ring and the pump casing, the pressure on the upstream and downstream sides of an orifice provided midway in a discharge passage is introduced into the respective chambers, and the differential pressure is made to act directly on the cam ring so as to appropriately move the cam ring against the urging force of a spring so as to change the volume of the pump chamber, thereby effecting appropriate discharge flow-rate control.

With such a conventional pump, however, the cam ring is held in the pump housing in such a manner as to be linearly movable, and is only made to undergo displacement by moving by means of the pressure differential between the upstream and downstream sides of the orifice provided directly or indirectly in the discharge passage. In addition, the numbers of component parts and fluid passages in various sections of the pump have been large, and there have been problems not only in machinability and assembly, but also in reliability operation and durability, so that its feasibility has been poor.

With reference to FIG. 6 and the like, a brief description will be given of an example of the variable-volume type vane pump described above. In the drawing, numeral 1 denotes a pump body; 2 denotes a cam ring which is disposed in an elliptical space 3 formed in the body 1 by means of a pivotally supporting portion 2*a*, and to which an urging force is imparted in the direction of the shadowed arrow in the drawing; 4 denotes a rotor which is accommodated in the cam ring 2 by being offset toward one side in such a manner as to form a pump chamber 5 on the other side, and which allows vanes 4*a* to project and to retract, the vanes 4*a* being held in such a manner as to be capable of radially advancing or retracting as the rotor 4 is rotatively driven by an external driving source.

Incidentally, numeral 4*b* in the drawing denotes a drive shaft of the rotor 4, and the rotor 4 is rotatively driven in the direction indicated by the arrow in the drawing. Further, numerals 3*a* and 3*b* denote passages for introducing control pressure for swinging and displacing the cam ring 2, e.g., fluid pressure or the like on the upstream and downstream sides of a variable orifice provided in a pump discharge-side passage, into chambers formed by being made open to the respective side chambers of the cam ring 2 in the body space 3. The arrangement provided is such that the cam ring 2 is made to undergo displacement by swinging in correspondence with the flow rate on the discharge side of the pump, thereby effecting discharge-side flow-rate control so as to reduce the discharge-side flow rate with an increase in the number of revolutions of the pump.

Numeral 6 denotes a pump suction-side opening which is open in face-to-face relation to a pump suction-side region 5A in the pump chamber 5; numeral 7 denotes a pump discharge-side opening which is open in face-to-face relation to a pump discharge-side region 5B in the pump chamber 5. These openings 6 and 7 are formed by either a pressure plate or a side plate (neither are shown) which are fixed wall portions for holding the pump component elements constituted by the rotor 4 and the cam ring 2 by clamping the same on both sides thereof.

In addition, numerals 8 and 9 denote a pair of fluid chambers which are formed as high-pressure and low-pressure sides, respectively, which are formed on both sides of the outer periphery of the cam ring 2 within the elliptical space 3. The fluid pressure or the like on upstream and downstream sides of the variable orifice in the pump discharge-side passage is introduced into these chambers 8 and 9 through the aforementioned passages 3*a* and 3*b*, whereby the cam ring 2 is made to undergo displacement by swinging in a required direction to make the volume of the pump chamber 5 variable, thereby variably controlling the discharge flow rate in correspondence with the flow rate on the discharge side of the pump.

Here, an urging force is imparted to the cam ring 2 from the fluid-pressure chamber 9 side as indicated by F in the drawing, so that the volume of the pump chamber 5 can be maintained at a maximum level at normal times. In addition, numeral 2*b* in the drawing denotes a seal member provided on the outer periphery of the cam ring 2 so as to define the fluid-pressure chambers 8 and 9 on both sides in association with the pivotally supporting portion 2*a* provided on the outer periphery of the cam ring 2.

Further, numerals 6*a* and 7*a* denote goatee-shaped notches which are formed in such a manner as to continue from terminating portions, in the rotating direction of the pump, of the pump suction-side opening 6 and the discharge-side opening 7. When distal ends of the vanes 4*a* are brought into sliding contact with the inner periphery of the cam ring 2 as the rotor 4 rotates so as to perform pumping action, these notches 6*a* and 7*a* function to allow the fluid pressure to escape gradually from the high-pressure side to the low-pressure side between the space sandwiched by vanes which approach the end portion of each opening 6 and 7 and the space between vanes adjacent thereto. Such notches 6*a* and 7*a* are effective in preventing the occurrence of the problem of pulsation in the fluid pressure on the discharge side of the pump due to the occurrence of sharp fluctuations in pressure and surge pressure as the space between the vanes 4*a* immediately reaches the end of each opening 6 and 7.

With the pump having the above-described construction, the arrangement provided is such that, as the rotor 4 is rotated, a required state of communication of the space defined by the adjacent vanes with each opening 6 and 7 is established after the space is made to communicate through each notch 6*a* and 7*a* with each opening 6 and 7, so as to allow the fluid pressure to escape gradually from the high-pressure side to the low-pressure side, and to control sharp fluctuations in pressure in the space between the vanes 4*a* and reduce the surge pressure, thereby preventing pulsation occurring in the fluid pressure on the discharge side of the pump.

According to the structure of the conventional variable displacement pump described above, there has been a problem in that, at the positions of the pump suction-side opening 6 and the pump discharge-side opening 7 in the pump chamber 5, pulsation on the pump discharge side is large, and the noise level on that side is also large.

This is attributable to the fact that the interior of the pump chamber ceases to be able to undergo precompression when the pump chamber formed between the vanes 4*a* is made to communicate with the pump discharge-side opening 7, so that this pump chamber is abruptly opened to the high-pressure region, resulting in large pulsation on the discharge side of the pump.

As measures against such a pulsation phenomenon, as shown in FIG. 7, an attempt has been made to offset the discharge-side opening 7 in the pump discharge-side region 5B within the pump chamber 5 by a predetermined angle toward the compression side (the pump suction-side region 5A side) within the pump chamber 5, so as to allow precompression. Also, an attempt has been made to form the goatee-shaped notch 7*a* such as the one described above in such a manner as to continue from a terminating end, in the rotating direction of the pump, of the pump discharge-side opening 7, i.e., the pump suction-side region 5A side, thereby making it possible to gradually open the pump chamber to the pump discharge-side opening 7.

However, as an issue encountered in devising such a measure, there sometimes arises an unbalanced force in the acting force due to the fluid pressure in the pump discharge-side region 5B since the pump chamber 5 is defined by the cam ring 2 which is swung about the pivotally supporting portion 2*a* within the pump body 1.

That is to say, as is apparent from FIG. 7, the angular ranges of the pump discharge-side opening 7 corresponding to the left and right fluid-pressure chambers 8 and 9 formed on both sides of the cam ring 2 with respect to the pivotally supporting portion 2*a* become $\alpha$ and $\alpha+\beta$, so that the pump discharge-side opening 7 which is open in the pump discharge-side region 5B is displaced toward the fluid-pressure chamber 9 which is the low-pressure side. The pump discharge-side pressure corresponding to the angular difference $\beta$ acts as an unbalanced force which causes the cam ring 2 to undergo swinging displacement rightwards in the drawing.

If the internal pressure at a portion of the cam ring 2 where its outer peripheral side corresponds to the low-pressure side fluid-pressure chamber 9, particularly the pressure within the chamber at a portion corresponding to the angle $\beta$, rises due to the positional displacement of the pump discharge-side opening 7 which is open in the pump chamber 5, then a force causing the cam ring 2 to swing in the direction indicated by the arrow in the drawing (i.e. a clockwise direction) acts due to the differential pressure in and outside the cam ring 2. Then, if the flow rate of pump discharge decreases due to a reduction in the volume of the pump chamber 5 entailed by such a movement, a problem inevitably arises in that it is difficult to secure the flow rate during loaded operation when the apparatus being used which receives the supply of the pressure fluid from this pump is operated, i.e., when the pump is under a load.

Besides, in Japanese Patent Application No. 4-358801 and the like, pumps having the following structure have been proposed: The cam ring 2 is arranged to be displaceable by moving in correspondence with the change in the number of revolutions of the pump, and in order to obtain a desired pump discharge flow rate by the displacement of the cam ring 2, a changeover valve which is changed over in correspondence with the fluctuations in the flow rate on the discharge side of the pump is provided for the left and right fluid-pressure chambers 8 and 9 defined around the outer periphery of the cam ring 2, so that the fluid pressures controlled to predetermined levels are supplied to the respective chambers by means of the valve.

Fluctuations and the like of the fluid pressure introduced into the left and right fluid-pressure chambers 8 and 9 on the outer periphery of the cam ring 2 in such a variable displacement pump are described below.

Namely, the fluid pressure $P_B$ in the low-pressure side fluid-pressure chamber 9 on the right-hand side in the drawing on the outer periphery of the cam ring 2 is apparent from the diagram shown in FIG. 8, and this fluid pressure $P_B$ is the cam-ring outer-surface pressure corresponding to the cam-ring inner-surface pressure on the right-hand side. Here, such $P_B$ is not completely made to communicate with the pump suction side (drain side) due to the function of the above-described changeover valve even in a flow-rate adjusting region where the number of revolutions of the pump has become large, and a state of a predetermined level of low pressure is maintained.

Meanwhile, the fluid pressure $P_A$ in the high-pressure side fluid-pressure chamber 8 on the left-hand side in the drawing on the outer periphery of the cam ring 2 is apparent from the diagram shown in FIG. 8, and this fluid pressure $P_A$ is the cam-ring outer-surface pressure corresponding to the cam-ring inner-surface pressure on the left-hand side in the drawing. This fluid pressure $P_A$ is slightly larger than the aforementioned $P_B$ in the flow-rate adjusting region. Then, the pressure differential between $P_A$ and $P_B$ at this time corresponds to a spring force F for urging the cam ring 2 leftwards in the drawing, and the fluid pressures $P_A$ and $P_B$ are normally balanced by this spring force F.

In such a relationship of pressure, the inner-surface pressure of the cam ring 2 and the outer-surface pressure of the cam ring in the case where the pump discharge-side opening 7 on the right-hand side of the cam ring 2 is displaced toward the low-pressure side fluid-pressure chamber 9 by an angular difference β, as described above, are described below. Here, the pump discharge-side pressure is set as P.

That is, if an unbalanced force acts due to the angular difference β described above, the pressure differential at the low-pressure side fluid-pressure chamber 9 portion is apparent from the diagram in FIG. 8 (pump discharge pressure $P-P_B$), so that the cam ring 2 is made to undergo displacement by swinging in the direction in which the volume of the pump chamber 5, i.e., the discharge rate, is reduced. In particular, such displacement of the cam ring 2 by swinging in the direction in which the discharge rate is reduced takes place in the flow-rate adjusting region.

In other words, if the cam ring 2 undergoes displacement by swinging and vibration due to the unbalanced force occurring owing to the above-described imbalance of the fluid pressure, large fluctuations in the flow rate occur on the discharge side of the pump. Hence, pulsation becomes large, and presents a problem in the characteristics of the pump, so that it is desirable to overcome such a problem.

In particular, such a problem is noticeable in cases where the fluid pressure rises in the main supply passage due to the operation of the equipment being used to which the fluid pressure from the variable displacement pump is supplied, and large fluctuations occur on the pump discharge-side pressure due to an increase in the pressure differential between the upstream and downstream sides of the metering orifice provided in that passage or midway in the pump discharge-side passage. Thus there has been a need to overcome such a problem.

For instance, in cases where the equipment being used is a power steering apparatus, a large amount of flow or a small amount of flow circulates to the power cylinder side, so that the steering wheel becomes suddenly heavy or light. It is desirable to overcome such instability.

The present invention has been devised in view of such circumstances, and its object is to obtain a variable displacement pump which is capable of eliminating swinging displacement which was liable to occur due to the swinging displacement caused by an unbalanced force occurring in and outside the cam ring, thereby reducing large fluctuations in the flow rate, pulsation and the like on the pump discharge side, and preventing the discharge flow rate from declining.

SUMMARY OF THE INVENTION

To meet such a demand, the variable displacement pump in accordance with the present invention comprises: a rotor with vanes which is rotatable in a pump body; a cam ring fitted in such a manner as to form a pump chamber between the cam ring and an outer periphery of the rotor, the cam ring being disposed in the pump body in such a manner as to be capable of undergoing displacement by moving, first and second fluid-pressure chambers being formed in a gap space on an outer periphery of the cam ring between the cam ring and the pump body by means of sealing means; urging means for urging the cam ring in a direction in which the volume of the pump chamber between the cam ring and the outer periphery of the rotor is made maximum; and a spool-type changeover valve which is operated in accordance with a pressure differential between upstream and downstream sides of a metering orifice provided in a pump discharge-side passage, so as to control fluid pressure supplied to the first and second fluid-pressure chambers in accordance with a relative magnitude of a discharge flow rate of the pressure fluid from the pump chamber, wherein the fluid pressure on the downstream side of the metering orifice introduced to the low pressure-side second chamber of the spool-type changeover valve is introduced into the second fluid-pressure chamber for imparting moving displacement in the direction in which the volume of the pump chamber is made maximum, of the fluid-pressure chambers on the outer periphery of the cam ring.

In addition, the variable displacement pump in accordance with the present invention comprises: a rotor with vanes which is rotatable in a pump body; a cam ring fitted in such a manner as to form a pump chamber between the cam ring and an outer periphery of the rotor, the cam ring being disposed in the pump body in such a manner as to be capable of undergoing displacement by moving, first and second fluid-pressure chambers being formed in a gap space on an outer periphery of the cam ring between the cam ring and the pump body by means of sealing means; urging means for urging the cam ring in a direction in which the volume of the pump chamber between the cam ring and the outer periphery of the rotor is made maximum; and a spool-type changeover valve which is operated in accordance with a pressure differential between upstream and downstream sides of a metering orifice provided in a pump discharge-side passage, so as to control fluid pressure supplied to the first fluid-pressure chamber in accordance with a relative magnitude of a discharge flow rate of the pressure fluid from the pump chamber, wherein the fluid pressure on the downstream side of the metering orifice and midway in the pump discharge-side passage is introduced into the second fluid-pressure chamber for imparting moving displacement in the direction in which the volume of the pump chamber is made maximum, of the fluid-pressure chambers on the outer periphery of the cam ring.

In addition, the variable displacement pump in accordance with the present invention is arranged such that a pump discharge-side opening which is open in a pump discharge-side region inside the pump chamber is formed by being offset toward a pump suction-side region up to a position where precompression is possible, and that a goatee-shaped notch is formed in the pump discharge-side opening which is open in the pump discharge-side region inside the pump chamber, in such a manner as to extend continuously from an end of the opening on a pump suction-side region side to a terminating portion thereof in a rotating direction of the pump.

In accordance with the present invention, the fluid pressure corresponding to the relative magnitude of the flow rate on the discharge side of the pump is introduced into the high pressure-side fluid-pressure chamber formed on the outer side of the cam ring, by means of the spool-type changeover valve, and the fluid pressure on the downstream side of the metering orifice in the pump discharge-side passage is introduced to the low pressure-side fluid-pressure chamber through the second chamber of the changeover valve or directly. As a result, it is possible to secure an appropriate flow rate during an initial period of pump operation, and when the pump is under a load such as when the equipment being used is operated, the cam ring is not displaced by swinging unnecessarily even when an unbalanced force acts due to the unbalanced fluid pressure in and outside the cam ring.

DETAILED DESCRIPTION OF THE PREFERRED EMBODIMENTS

FIGS. 1 to 4 show an embodiment of a variable displacement pump in accordance with the present invention. In these drawings, in this embodiment, a description will be given of a case where the variable displacement pump is used as a vane-type oil pump constituting an oil-pressure generating source for a power steering apparatus.

Figure 1:
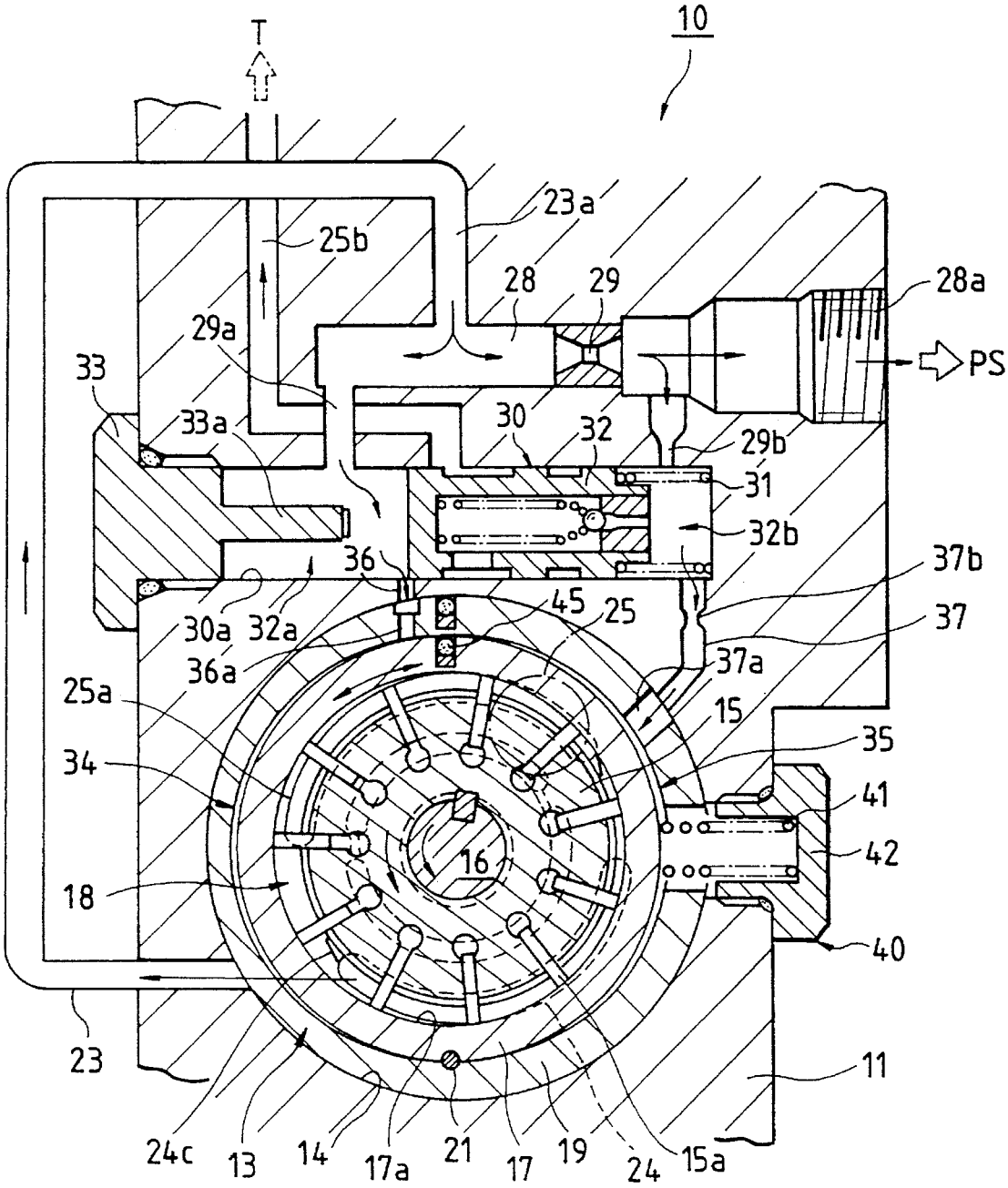
FIG. 1 is a schematic transverse cross-sectional view of an embodiment of a variable displacement pump in accordance with the present invention, and illustrates the structure of essential portions of the pump.
Figure 2:
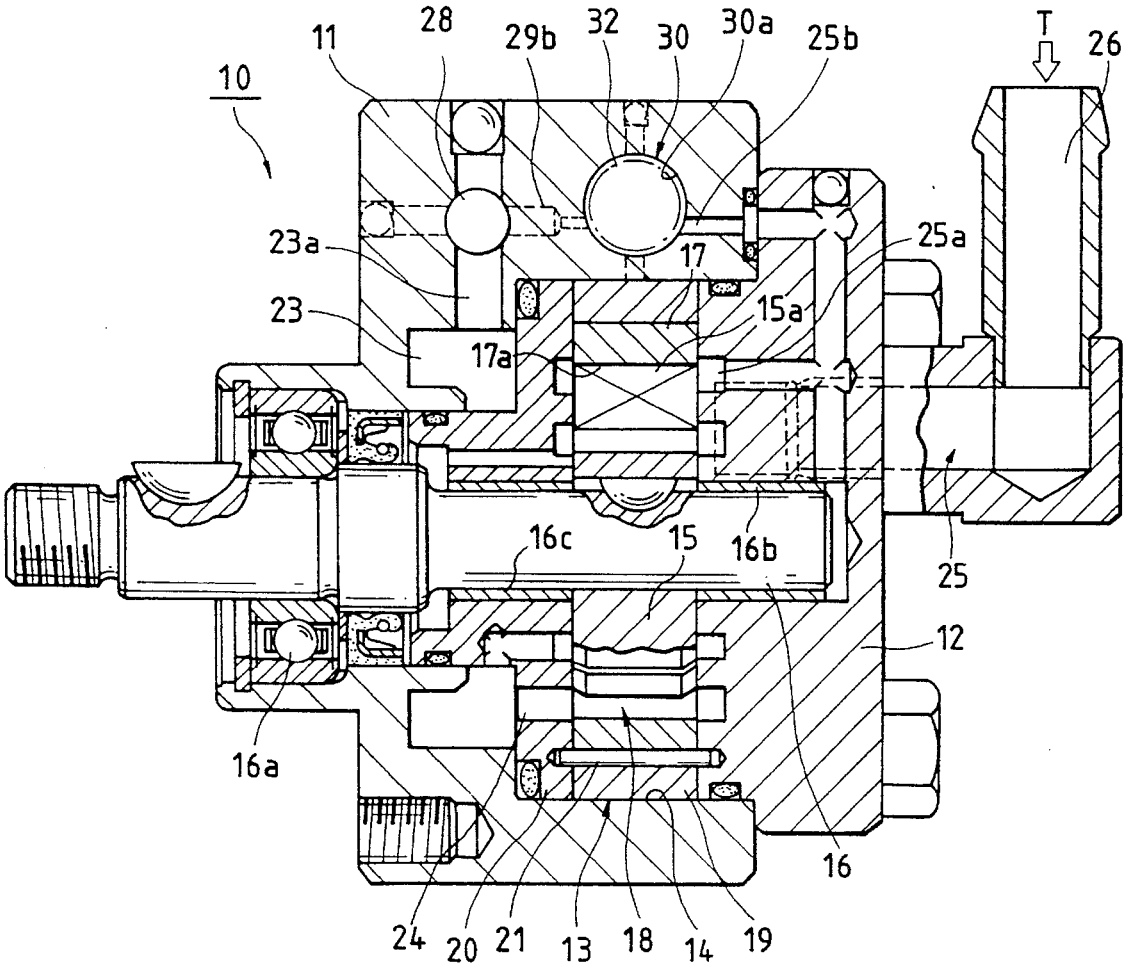
FIG. 2 is a longitudinal cross-sectional view of the essential portions illustrating the structure of the essential portions shown in FIG. 1.

First, as is apparent from FIGS. 1 and 2, a vane-type variable displacement pump generally designated at numeral 10 has a front body 11 and a rear body 12 which constitute a pump body. As is apparent from FIG. 2, this front body 11 as a whole is substantially cup-shaped, and an accommodating space 14 for accommodating pump component elements 13 is formed therein. The rear body 12 is combined with the front body 11 in such a manner as to close an open end of the accommodating space 14, and is thereby formed integrally with the front body 11. In a state in which a drive shaft 16 for rotatively driving a rotor 15, i.e., a rotating element of the pump component elements 13, from outside is inserted in the front body 11, the drive shaft 16 is rotatively supported by bearings 16*a*, 16*b*, and 16*c* (the bearing 16*b* is disposed on the rear body 12 side, and the bearing 16*c* is disposed on a pressure plate 20 side, which will be described later).

Numeral 17 denotes a cam ring which has an inner cam surface 17*a* disposed by being fitted around an outer periphery of the rotor 15 having vanes 15*a*. The cam ring 17 forms a pump chamber 18 between the inner cam surface 17*a* and the rotor 15. The cam ring 17 is disposed in an adapter ring 19 provided in a fitted state on an inner wall portion within the accommodating space 14, such that the cam ring 17 is capable of undergoing displacement by moving, so as to make the volume of the pump chamber 18 variable, as will be described later.

Incidentally, the adapter ring 19 is for holding the cam ring 17 within the accommodating space 14 in the body 11 such that the cam ring 17 is capable of undergoing displacement by moving.

Numeral 20 denotes the pressure plate which is superposed on and held in pressure contact with the front body 11 side of a pump cartridge which is made up of the rotor 15, the cam ring 17, and the adapter ring 19. Meanwhile, an end face of the rear body 12 is brought into pressure contact with the opposite face of the pump cartridge as a side plate. In this state, the body 11 and the body 12 are assembled into an integral unit and are set in a required assembled state. The pump component element 18 are constituted by these members.

Here, the pressure plate 20 and the rear body 12, which also serves as the side plate superposed thereon via the cam ring 17, are integrally assembled and fixed in a state of being positioned in the rotating direction, by means of a seal pin 21, which will be described later and which also serves as a pivotally supporting portion for the swinging displacement of the cam ring 17 and a positioning pin, as well as by means of appropriate rotation-preventing means (not shown).

Numeral 23 denotes a pump discharge-side pressure chamber which is adapted to exert the pump discharge-side pressure upon the pressure plate 20. Numeral 24 denotes a pump discharge-side passage bored in the pressure plate 20 for introducing pressure oil from the pump chamber 18 into the pump discharge-side pressure chamber 23.

Numeral 25 denotes a pump suction-side passage formed in the rear body 12 so as to introduce into the pump chamber 18 a pump suction-side fluid from a suction port 26 (a detailed illustration is omitted) provided in a part of the rear body 12. This passage 25 is connected to the pump chamber 18 via a pump suction opening 25*a* which is open at the end face of the rear body 12.

Numeral 28 denotes a pump discharge-side passage which is connected to the pump chamber 18 via the pump discharge-side passage 24, the pump discharge-side pressure chamber 23, and a passage hole 23*a* extending from the pressure chamber 23 to above the front body 11. A metering orifice 29 is interposed midway in the passage 28, and a discharge port 28*a* is provided at an outer end of the passage 28 for supplying the pump discharge-side fluid pressure to hydraulic equipment such as the power steering apparatus (indicated by PS in the drawings).

Numeral 30 denotes a changeover valve which is disposed above the accommodating space 14 in the front body 11 substantially perpendicularly thereto, and is adapted to move and displace the aforementioned cam ring 17 in the pump chamber 11 (adapter ring 19) relative to the rotor 15. This changeover valve 30 has a spool 32 with a relief valve which undergoes sliding operation in a valve hole 30*a* bored in the body 11 by means of the urging force of a spring 31 and the pressure differential between the upstream and downstream sides of the metering orifice 29 in the pump discharge-side passage 28.

Incidentally, in the drawings, numerals 29*a* and 29*b* denote passages for introducing the pressure on the upstream and downstream sides, respectively, of the orifice 29 into the valve hole 30*a*. Further, a low pressure-side passage 25*b* branching off from a portion of the pump suction-side passage 25 for introducing the fluid pressure to the tank side is formed at the central portion of the valve hole 30*a*. As the spool 32 is moved, the opening and closing of the changeover valve 30 is selectively controlled so as to introduce the fluid pressure to first and second fluid-pressure chambers on the cam ring 17 side, as will be described later.

Namely, in such a changeover valve 30, the fluid pressure on the upstream side of the metering orifice 29 is introduced into one chamber (a first chamber which is on the left-hand side in FIG. 1 and is the high-pressure side) 32*a* of the spool 32 via the pump discharge-side pressure chamber 23, the pump discharge-side passage 28, and the passage 29*a*. Incidentally, numeral 33 in the drawing denotes a closing plug for closing the valve hole 30*a* and having a rod 33*a* for stopping the position of the leftward movement of the spool 32 inside the valve hole 30*a* to a position where the open end of the passage 29*a* is not closed.

In addition, the spring 31 is disposed in another chamber (a second chamber which is on the right-hand side in FIG. 1 and is the low-pressure side) 32*b*, and the fluid pressure on the downstream side of the metering orifice 29 is introduced into the other chamber 32*b* via the passage 29*b* from a midway position of the passage 28 leading to the discharge port 28*a*.

Further, pressure-introducing passages 36 and 37 (including passage holes 36*a* and 37*a* in the adapter ring 19) which are formed via the body 11 and the adapter ring 19 are open at first and second fluid-pressure chambers 34 and 35 which are formed on the outer periphery of the cam ring 19 between the same and the body 11-side adapter ring 19. Incidentally, a recessed groove or the like, which makes it possible to secure the first fluid-pressure chamber 34 when the outer periphery of the cam ring 17 is in contact with the adapter ring 19, may be formed in the outer periphery of the cam ring 17.

As is apparent from FIGS. 1 and the like, due to the movement of the spool 32, these passages 36 and 37 are selectively connected to the pump discharge-side passage 28 via the passage 29*b* or to the pump suction-side opening 25*a* via the passage 25*b*.

Namely, the fluctuation in the flow rate on the discharge side during the operation of the pump is detected by the changeover valve 30 which is operated by the pressure differential between the upstream and downstream sides of the metering orifice 29. The fluid pressure controlled by the valve 30 is supplied to the first and second fluid-pressure chambers 34 and 35 on both sides of the cam ring 17, whereby the cam ring 17 can be displaced by swinging in a required state to make the volume of the pump chamber 18 variable, thereby making it possible to control the discharge flow rate of the pump in a required state.

Here, numeral 40 in FIG. 1 denotes a pressing member for urging the cam ring 17 disposed displaceably by moving inside the pump bodies 11 and 12, such that the volume of the pump chamber 18 formed between the cam ring 17 and the outer periphery of the rotor 15 becomes maximum. The pressing member 40 is constituted by a coil spring 41 and a tubular pressing plug 42.

It should be noted that, in the above-described vane-type variable displacement pump 10, the arrangements other than those described above are conventionally well-known, and a detailed description thereof will be omitted.

In accordance with the present invention, the variable displacement pump 10 arranged as described above comprises: the cam ring 17 fitted in such a manner as to form the pump chamber 18 between the cam ring 17 and the outer periphery of the rotor 15, the cam ring 17 being disposed displaceably by moving (displaceably by swinging) in the pump bodies 11 and 12, the first and second fluid-pressure chambers 34 and 35 being formed in the gap space on the outer periphery of the cam ring 17 between the cam ring 17 and the pump bodies 11 and 12 by means of the sealing means 21 and 45; the coil spring 41 serving as the urging means for urging the cam ring 17 in the direction in which the volume of the pump chamber 18 between the cam ring 17 and the outer periphery of the rotor 15 is made maximum; and the spool-type changeover valve 30 which is operated in accordance with the pressure differential between the upstream and downstream sides of the metering orifice 29 provided in the pump discharge-side passage 28, so as to control the fluid pressure supplied to the first and second fluid-pressure chambers 34 and 35 in accordance with the relative magnitude of the discharge flow rate Q of the pressure fluid from the pump chamber 18.

In such an arrangement, the characteristic feature lies in that the fluid pressure on the downstream side of the metering orifice 29 introduced to the low pressure-side second chamber 32*b* of the spool-type changeover valve 30 is introduced via the introducing passage 37 into the second fluid-pressure chamber 35 for imparting moving displacement in the direction in which the volume of the pump chamber 18 is made maximum (leftward in FIG. 1), of the fluid-pressure chambers 34 and 35 on the outer periphery of the cam ring 17.

Here, numeral 37*b* in the drawing denotes a throttle provided in the introducing passage 37. Although the response characteristic in the control function declines slightly due to the provision of the throttle 37*b*, the throttle 37*b* is effective in further enhancing the effect of damping the cam ring 17.

In accordance with such an arrangement, the fluid pressure corresponding to the relative magnitude of the pump discharge-side flow rate Q is introduced into the high pressure-side fluid-pressure chamber 34 formed on the outer side of the cam ring 17 by means of the spool-type changeover valve, and the fluid pressure on the downstream side of the metering orifice 29 in the pump discharge-side passage 28 is introduced into the low pressure-side fluid-pressure chamber 35 via the low pressure-side second chamber 32*b* of the changeover valve 30. Accordingly, during the initial period of operation of the pump 10, the discharge flow rate is controlled as required, thereby making it possible to obtain a predetermined flow rate. In addition, when the pump is under a load such as during the operation of the equipment being used, it is possible to overcome the conventional drawback that an unbalanced force acts due to the unbalanced fluid pressure in and outside the cam ring 17, causing the cam ring 17 to be displaced by swinging undesirably. Consequently, it is possible to overcome fluctuations in the flow rate on the discharge side of the pump, and effect stable flow-rate control.

In other words, in such an arrangement, the pressure on the downstream side of the metering orifice 29, which is substantially close to the discharge pressure of such a measure that it is capable of opposing the rise in pressure within the cam ring 17 caused by fluctuations in fluid pressure, is introduced into the low pressure-side fluid-pressure chamber 35 on the outer side of the cam ring 17. Consequently, as is apparent from characteristic diagrams shown in FIGS. 3 and 4, it is possible to prevent fluctuations in the flow rate or a decline in the flow rate from occurring even if the discharge-side pressure P rises due to the pump load or the like.

In particular, when tile pump 10 is under a load due to the operation of the equipment being used to which the fluid pressure from the pump 10 is supplied, it is possible to prevent the problem of such as a decline in the flow rate from occurring even if the pump discharge-side fluid pressure P rises.

Figure 3:
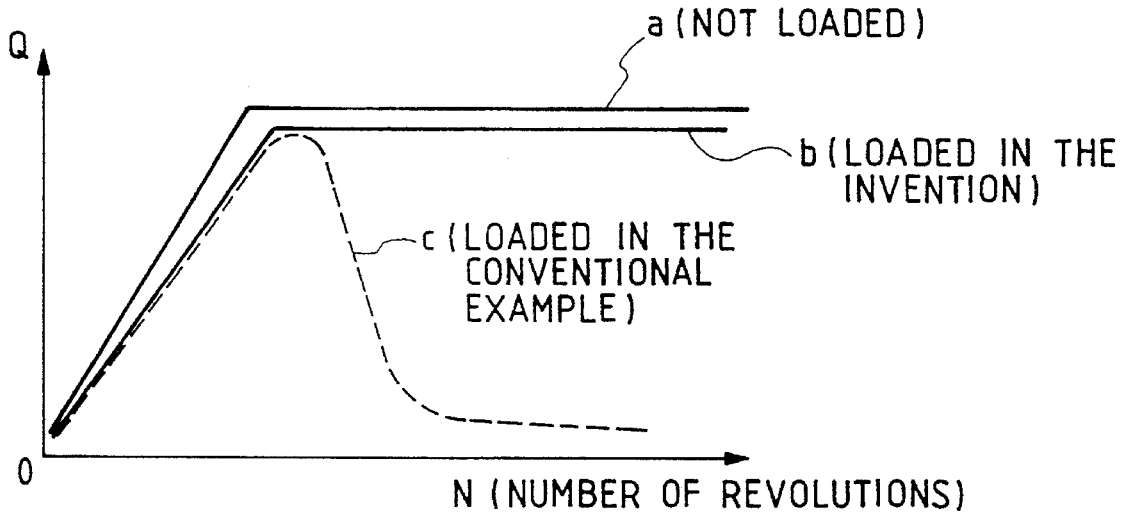
FIG. 3 is a characteristic diagram illustrating the relationship between the number of revolutions N of the pump and the discharge flow rate Q in accordance with the present invention.
Figure 4:
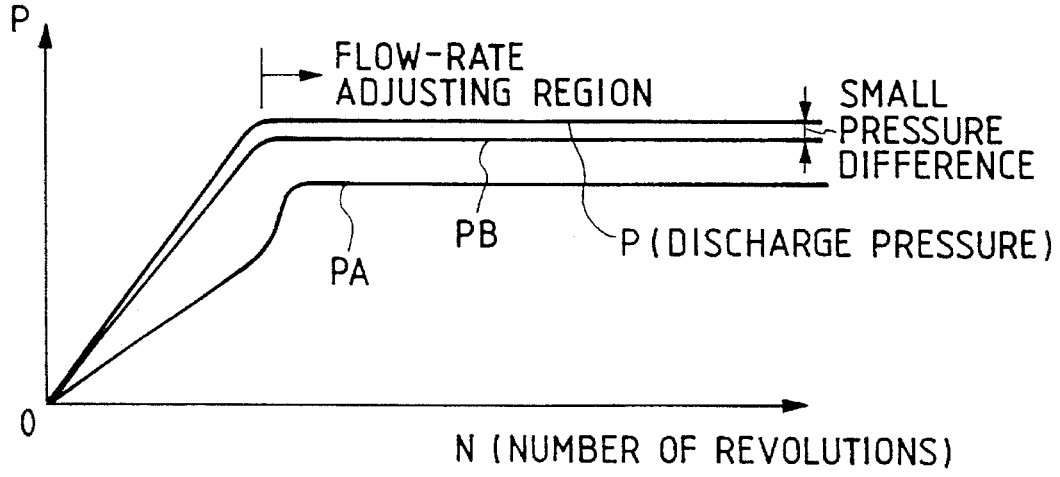
FIG. 4 is a characteristic diagram illustrating the relationship between the number of revolutions N of the pump and the pump discharge-side pressure P in accordance with the present invention.

To give a brief description of this mechanism with reference to FIGS. 3 and 4, to overcome the movement of the cam ring 17 in the direction of reducing the discharge rate due to the unbalanced force described above, the fluid pressure on the downstream side of the metering orifice, which is substantially close to the discharge pressure, is introduced as the fluid pressure $P_B$ in the low pressure-side fluid-pressure chamber 35.

If this arrangement is adopted, the pressure ($P_B$) which is substantially equivalent to the pump discharge-side pressure P can be introduced into the low pressure-side fluid-pressure chamber 35. As a result, it is possible to reduce the pressure differential ($P-P_B$) between the inner and outer sides of the cam ring 17, so that even if the discharge-side fluid pressure P rises as when the pump is under a load due to the operation of the power steering apparatus or the like, i.e., the apparatus being used, it is possible to prevent a decline in the flow rate Q, thereby making it possible to control the flow rate of the pump on a stable basis.

In addition, although, in conventional pump structures, passages and the like, which were made to communicate with the pump suction side in a flow-rate adjusting region during control and to which the pressure on the upstream side of the metering orifice 29 was introduced immediately after the actuation of the pump, were required, if such an arrangement is adopted, these passages and the like are made unnecessary. Hence, it is possible to simplify the structures of the relevant component parts, and to improve the machinability and the like of the component parts.

Here, during a rise in such pump discharge-side fluid pressure, the pressure differential in the fluid pressure to the left and right fluid-pressure chambers 34 and 35 for controlling the swinging displacement of the cam ring 17 is controlled by the changeover valve 30.

In the present invention, under such circumstances, an unbalanced force to the cam ring 17 is eliminated in such a manner as to control only the portion of the adjusted flow rate. This is attributable to the fact that, in FIG. 3, the flow-rate characteristic under no load in accordance with the present invention is shown by a and the flow-rate characteristic under a load is shown by b, and a sharp decline in the flow rate in the flow-rate adjusting region, as in the case of the flow-rate characteristic c under a load in a conventional structure, does not occur.

Furthermore, the situation of pressure in accordance with the present invention is shown in FIG. 4, and in the present invention the pressure differential between the pump discharge pressure P and the fluid pressure $P_B$ in the second fluid-pressure chamber 34 is small in the flow-rate adjusting region. Its advantages in operation will be readily understood.

Figure 7:
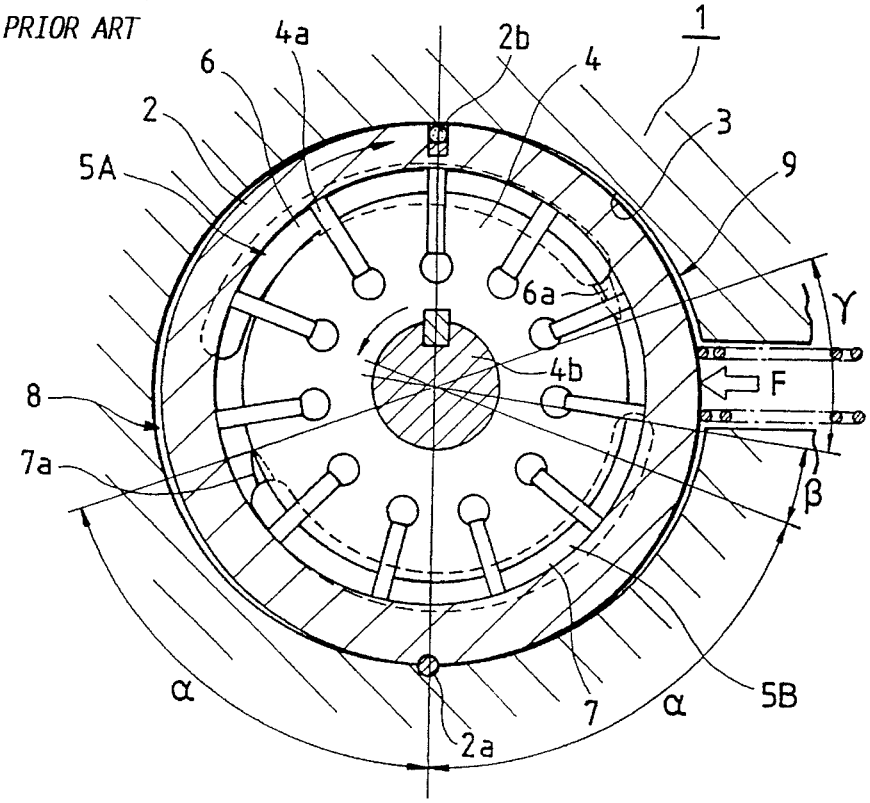
FIG. 7 PRIOR ART
FIG. 7 is a schematic explanatory diagram illustrating another example of the conventional variable displacement pump.
Figure 8:
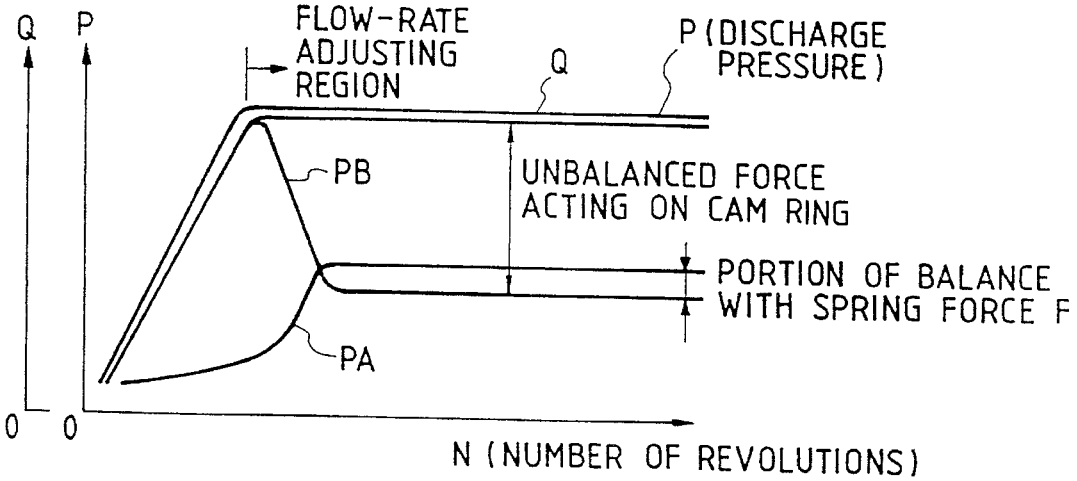
FIG. 8 PRIOR ART
FIG. 8 is a characteristic diagram illustrating the relationships among the number of revolutions N of the pump, the pump discharge-side pressure P, and the discharge flow rate Q of the conventional pump.

In addition, in this embodiment, in the same way as in the conventional example shown in FIG. 7 referred to earlier, the pump discharge-side opening 24, which is open in the pump discharge-side region inside the pump chamber 18, is formed by being offset toward the pump suction-side region up to a position where precompression is possible. Additionally, a goatee-shaped notch **24*c* is formed in the pump discharge-side opening 24, which is open in the pump discharge-side region inside-the pump chamber 18, in such a manner as to extend continuously from an end of the opening 24** on the pump suction-side region side to a terminating portion thereof in the rotating direction of the pump. Thus, the operating characteristic of the pump is stabilized, and it is possible to effect desired fluid-pressure control and flow-rate control.

Here, in the above-described embodiment, in order to divide the annular gap space between the cam ring 17 and the adapter ring 19, there are provided the first seal pin 21, which also functions as the aforementioned positioning pin, and the second seal pin 45 incorporated in a groove formed in the sliding-contact surface of the cam ring 17 via a resilient member, the first and second seal pins 21 and 45 being disposed at and lower positions in such a manner as to divide the annular gap space into left- and right-hand parts, as is apparent from FIGS. 1 and 2.

The left-hand space is formed as the first fluid-pressure chamber 34, and this chamber 34 is arranged to be selectively connectable to the first chamber **32*a* of the changeover valve 30 via the fluid passages 36*a* and 36** or to the suction side of the pump.

Meanwhile, the right-hand space is formed as the second fluid-pressure chamber 35, and this chamber 35 is arranged to be connectable to the downstream side of the metering orifice 29 via the low pressure-side second chamber **32*b* in the changeover valve 30 through the fluid passages 37*a* and 37**.

Furthermore, as is apparent from FIG. 1, the above-described tubular pressing member 40 is arranged to constantly press the cam ring 17 leftward in FIG. 1 by means of the coil spring 41. Incidentally, this pressing member 40 may be provided with any shape insofar as it is capable of pressing the cam ring 17 such that the content volume of the pump cylinder 18 becomes always maximum.

In accordance with the above-described arrangement, when the pump 10 is started, the cam ring 17 is in the state of being urged by the coil spring 41 of the pressing member 40 such that the content volume becomes maximum on one side within the accommodating space 14 in the body 11, as is apparent from FIG. 1. At this time, the changeover valve 30 is in such a state that, unlike in FIG. 1, the first fluid-pressure chamber 34 is connected to the suction side, and the second fluid-pressure chamber 35 is connected to the downstream side of the metering orifice 29 on the pump discharge side.

Then, as the number of revolutions of the pump gradually increases and the pump is driven, the spool 32 of the changeover valve 30 is changed over by the differential pressure due to the fluid pressure across the upstream and downstream sides of the orifice 29 on the discharge side of the pump, which is obtained in proportion to the number of revolutions of the pump. As a result, in the flow-rate adjusting region, the first fluid-pressure chamber 34 on the outer side of the cam ring 17 is connected to the upstream side of the metering orifice 29 on the discharge side of the pump, while the second fluid-pressure chamber 35 is connected to the downstream side of the metering orifice 29. This causes the cam ring 17 disposed eccentrically with respect to the rotor 15 to be displaced by moving in the direction in which the content volume of the pump chamber 18 is reduced (see FIG. 1) against the coil spring 41.

At this juncture, through the changeover operation by the spool 32 of the changeover valve 30 in correspondence with the relative magnitude of the rate of the fluid flow on the discharge side of the pump, the pump discharge side is connected, as required, to the first fluid-pressure chamber 34, while the downstream side of the orifice 29 which is held under a pressure lower than that of the second fluid-pressure chamber 35 is connected, as required, to the second fluid-pressure chamber 35 located in opposition to the first fluid-pressure chamber 34. Hence, the cam ring 17 is displaced, as required, by moving in accordance with the operating state of the changeover valve 30, with the result that the flow rate of the fluid discharged from the pump chamber 18 whose content volume is changed can be controlled under a required condition, thereby making it possible to supply the fluid at a predetermined flow rate to the power steering apparatus PS.

In particular, in accordance with the above-described arrangement, the changeover of the changeover valve 30 is controlled in correspondence with the differential pressure occurring in the metering orifice 29 through the pump discharge rate which increases or decreases with the number of revolutions of the pump, whereby the cam ring 17 is made to undergo displacement by moving rightwards in the drawing against the urging force of the coil spring 41 or leftwards in the drawing by the urging force. Consequently, it is possible to variably control the content volume of the pump chamber 18 and balance the rate of discharge from the pump in correspondence with the number of revolutions of the pump, so as to obtain desired characteristics, as shown in FIGS. 3 and 4.

Here, in this embodiment, the cam ring 17 is arranged to be capable of undergoing displacement by moving in the state in which the cam ring 17 is made eccentric to the rotor 15, and its inner peripheral wall can be formed in a completely round shape. Hence, there is an advantage in which the cam ring 17 excels in machinability.

Figure 5:
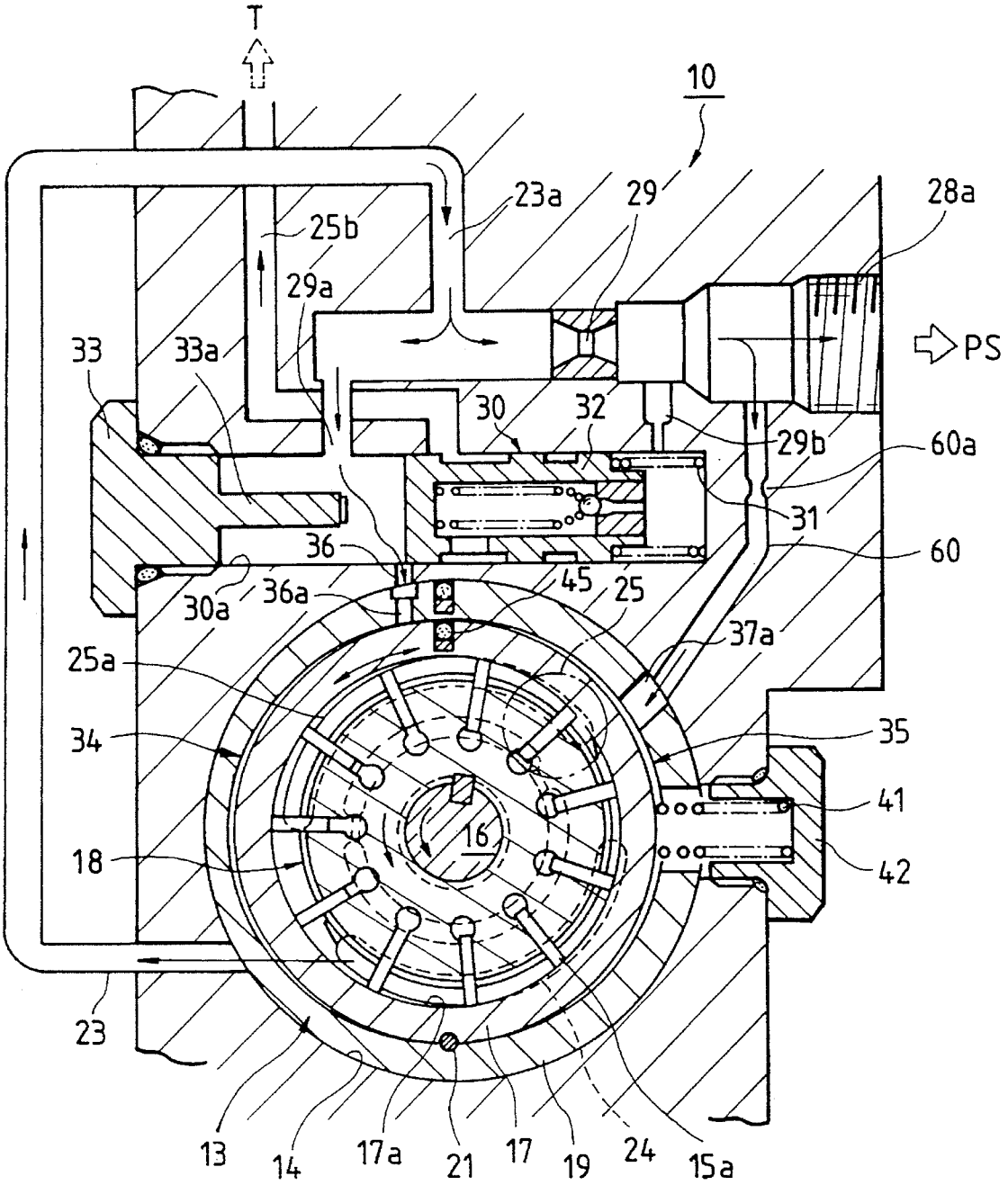
FIG. 5 is a schematic transverse cross-sectional view of another embodiment of the variable displacement pump in accordance with the present invention, and illustrates the structure of essential portions of the pump.
Figure 6:
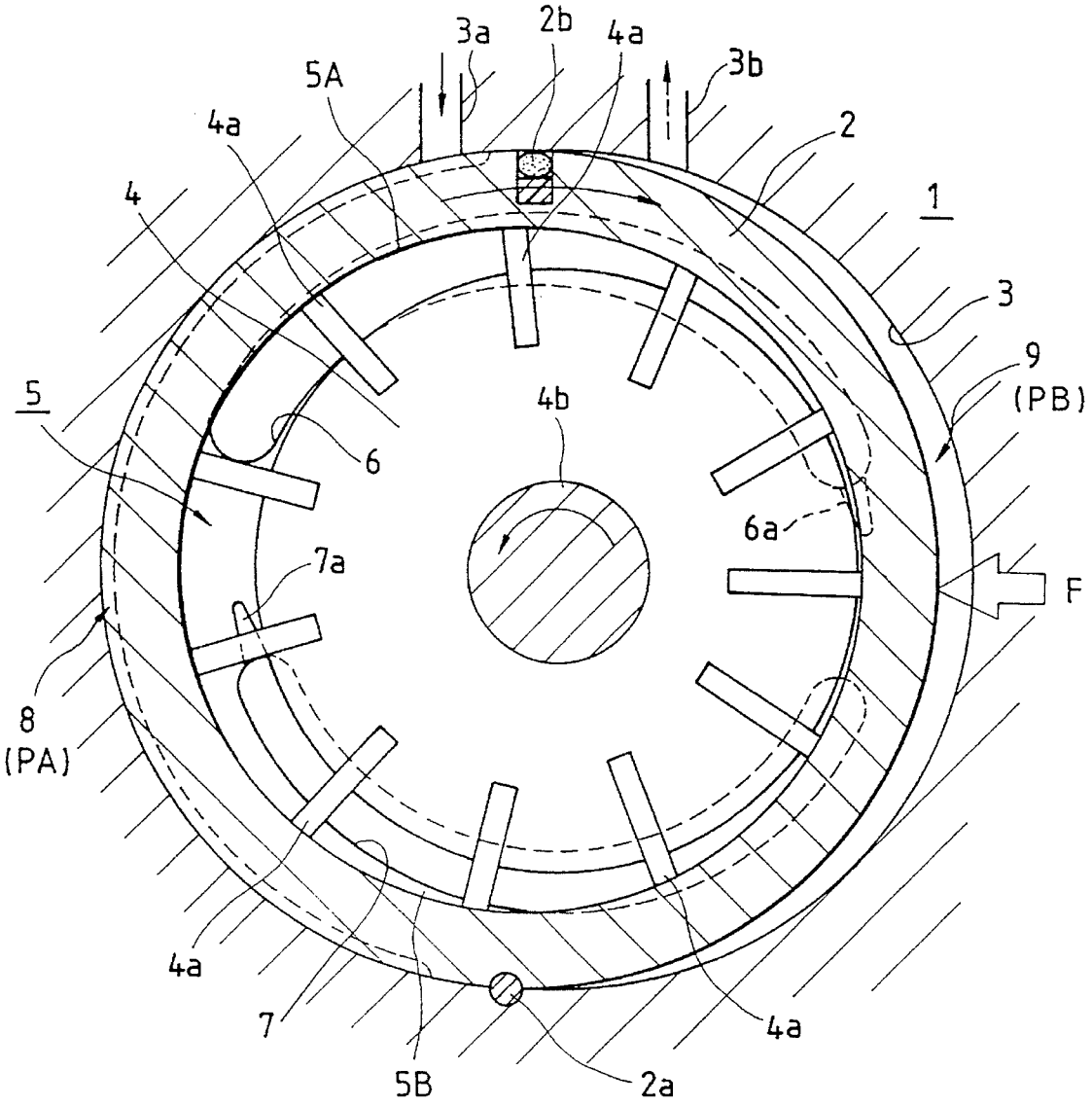
FIG. 6 PRIOR ART
FIG. 6 is a schematic diagram explaining the structure of essential portions of a conventional variable displacement pump.

FIG. 5 shows another embodiment of the variable displacement pump in accordance with the present invention. In this embodiment, a changeover valve 30 is used which is operated in correspondence with the pressure differential between the upstream and downstream sides of the metering orifice 29 provided in the pump discharge-side passage 28, and which controls the fluid pressure $P_A$ supplied to the first fluid-pressure chamber 34 in correspondence with the relative magnitude of the discharge flow rate Q of the pressure fluid from the pump chamber 18. At the same time, the fluid pressure on the downstream side of the metering orifice 29 midway in the pump discharge-side passage 28 is arranged to be directly introduced into the second fluid-pressure chamber 35 for imparting the moving displacement in the direction in which the volume of the pump chamber 18 is maximum, of the fluid chambers on the outer periphery of the cam ring 17, through an introducing passage 60 provided in the body 11, unlike the above-described embodiment.

Incidentally, numeral **60*a* in the drawing denotes a throttle in the introducing passage 60, and the effect of damping the cam ring 17 is obtained by this throttle 60*a***, as described in the above-described embodiment.

It will be readily appreciated that, by the structure of such an embodiment as well, it is possible to obtain advantages in operation which are substantially similar to those of the above-described embodiment.

In addition, with such an arrangement, the passage passing through the valve 30 is not required in the manner of the above-described embodiment, and the simple passage 60 in the body is sufficient. Therefore, there are advantages in that the arrangement is simplified, and that the machinability and assembling efficiency of the various component parts are improved.

It should be noted that the present invention is not limited to the structures of the above-described embodiments, and the shapes, structures and the like of the various component parts may be modified or altered freely, as required, and various modifications are conceivable.

Although, in the above-described embodiments, a case has been illustrated in which the annular gap space for holding the cam ring 17 in such a manner as to allow the cam ring 17 to undergo displacement by moving is formed between the cam ring 17 and the adapter ring 19, the present invention is not limited to the same. For instance, an arrangement may be provided such that the cam ring 17 is held in the pump body 11 in such a manner as to allow the cam ring 17 to undergo displacement by moving.

Furthermore, it goes without saying that the vane-type variable displacement pump 10 having the above-described arrangement is not limited to the structures of the above-described embodiments, and may be applied to various equipment and apparatuses other than the power steering apparatus described in the above-described embodiments.

As described above, in accordance with the present invention, the variable displacement pump in accordance with the present invention comprises: the rotor with vanes which is rotatable in the pump body; the cam ring fitted in such a manner as to form a pump chamber between the cam ring and the outer periphery of the rotor, the cam ring being disposed in the pump body in such a manner as to be capable of undergoing displacement by moving, first and second fluid-pressure chambers being formed in a gap space on the outer periphery of the cam ring between the cam ring and the pump body by means of sealing means; urging means for urging the cam ring in a direction in which the volume of the pump chamber between the cam ring and the outer periphery of the rotor is made maximum; and the spool-type changeover valve which is operated in accordance with the pressure differential between upstream and downstream sides of the metering orifice provided in the pump discharge-side passage, so as to control fluid pressure supplied to the first and second fluid-pressure chambers in accordance with the relative magnitude of the discharge flow rate of the pressure fluid from the pump chamber, wherein the fluid pressure on the downstream side of the metering orifice introduced to the low pressure-side second chamber of the spool-type changeover valve is introduced into the second fluid-pressure chamber on the outer peripheral side of the cam ring for imparting moving displacement in the direction in which the volume of the pump chamber is made maximum. Accordingly, despite its simple structure, the variable displacement pump exhibits the following outstanding advantages.

In accordance with the present invention, the fluid pressure corresponding to the relative magnitude of the flow rate on the discharge side of the pump is introduced into the high pressure-side fluid-pressure chamber formed on the outer side of the cam ring, by means of the spool-type changeover valve, and the fluid pressure on the downstream side of the metering orifice in the pump discharge-side passage is introduced to the low pressure-side fluid-pressure chamber. As a result, it is possible to overcome the drawback that when the pump is under a load such as when the equipment being used is operated, the cam ring is swung unnecessarily as an unbalanced force acts due to the unbalanced fluid pressure in and outside the cam ring. Consequently, it is possible to overcome fluctuations in the flow rate or a decline in the flow rate on the discharge side of the pump.

In other words, in accordance with the present invention, the pressure on the downstream side of the metering orifice, which is substantially close to the discharge pressure of such a measure that it is capable of opposing the rise in pressure within the cam ring caused by fluctuations in fluid pressure, is introduced into the low pressure-side fluid-pressure chamber on the outer side of the cam ring. Hence, it is possible to prevent fluctuations in the flow rate or a decline in the flow rate even if the discharge-side pressure rises when the pump is under a load.

In particular, in accordance with the present invention, it is possible to prevent the occurrence of the problem that the flow rate declines even if the pump discharge-side fluid pressure rises when the pump is under a load due to the operation of the equipment being used to which the fluid pressure is supplied from the pump.

Further, in accordance with the present invention, it is possible to simplify the arrangement of the passages inside the pump, and improve the machinability and the like of the component members as a result.

In addition, the spool-type changeover valve is arranged such that it is operated in accordance with the pressure differential between upstream and downstream sides of the metering orifice provided in the pump discharge-side passage, so as to control fluid pressure supplied to the first fluid-pressure chamber in accordance with the relative magnitude of the discharge flow rate of the pressure fluid from the pump chamber. Also, the fluid pressure on the downstream side of the metering orifice and midway in the pump discharge-side passage is introduced into the second fluid-pressure chamber for imparting moving displacement in the direction in which the volume of the pump chamber on the outer peripheral side of the cam ring is made maximum. Accordingly, despite its simple structure, the variable displacement pump is capable of exhibiting advantages in operation which are similar to those described above.

Furthermore, the variable displacement pump in accordance with the present invention is arranged such that the pump discharge-side opening which is open in the pump discharge-side region inside the pump chamber is formed by being offset toward the pump suction-side region up to the position where precompression is possible, and that the goatee-shaped notch is formed in the pump discharge-side opening which is open in the pump discharge-side region inside the pump chamber, in such a manner as to extend continuously from an end of the opening on the pump suction-side region side to a terminating portion thereof in the rotating direction of the pump. As a result, the compression of the fluid within the pump chamber can be effected in a required state, and it is possible to expect further advantages in operation in alleviating a decline in the flow rate and the like on the discharge side of the pump.

What is claimed is:

1. A variable displacement pump comprising:

a pump body having an accommodating space and a plurality of passages;

a rotor having vanes and disposed rotatably in said accommodating space of said pump body;

a cam ring displaceably arranged around said rotor in said accommodating space of said pump body to form a variable pump chamber between said cam ring and an outer periphery of said rotor, and variable first and second fluid-pressure chambers between an outer periphery of said cam ring and said pump body with the aid of sealing means;

a metering orifice provided in a pump discharge-side passage;

urging means for urging said cam ring in a direction in which the volume of said pump chamber is made maximum; and a spool-type changeover valve means for controlling fluid pressure applied to said first and second fluid-pressure chambers in accordance with a discharge flow rate of pressured fluid from said pump chamber and a pressure differential between upstream and downstream sides of said metering orifice, wherein the fluid pressure on the downstream side of said metering orifice is introduced into said second fluid-pressure chamber which is provided for enabling the displacement of said cam ring in the direction in which the volume of said pump chamber is increased.

2. A variable displacement pump according to claim 1, wherein a pump discharge-side opening which is open in a pump discharge-side region inside said pump chamber is offset in a circumferential direction toward a pump suction-side region up to a position where precompression is possible.

3. A variable displacement pump according to claim 1, further comprising:

a goatee-shaped notch formed to continuously extend in a rotating direction of rotor from an end of a pump discharge-side opening which is open in a pump discharge-side region of said pump chamber.

4. A variable displacement pump according to claim 1, further comprising:

a throttle formed in an introducing passage communicating said downstream side of said metering orifice with said second fluid-pressure chamber.

5. A variable displacement pump, as claimed in claim 1, wherein said pump body is provided with a fluid passage communicating the downstream side of the orifice with the second pressure chamber at all times.

6. A variable displacement pump according to claim 1, wherein the fluid pressure on the downstream side of said metering orifice is introduced through a low pressure-side chamber of said spool-type changeover valve means into said second fluid-pressure chamber.

7. A variable displacement pump according to claim 6, wherein a pump discharge-side opening which is open in a pump discharge-side region inside said pump chamber is offset in a circumferential direction toward a pump suction-side region up to a position where precompression is possible.

8. A variable displacement pump according to claim 6, further comprising:

a goatee-shaped notch is formed to continuously extend in a rotating direction of rotor from an end of a pump discharge-side opening which is open in a pump discharge-side region of said pump chamber.

9. A variable displacement pump according to claim 6, further comprising:

a throttle formed in an introducing passage communicating said low-pressure-side chamber of said spool type changeover valve means with said second fluid-pressure chamber.

* * * * *